United States Patent [19]

Matsuda

[11] Patent Number: 4,774,145

[45] Date of Patent: Sep. 27, 1988

[54] ZINC PHOSPHATE CHEMICAL CONVERSION FILM AND METHOD FOR FORMING THE SAME

[75] Inventor: Shigeki Matsuda, Okazaki, Japan

[73] Assignee: Nippondenso Co., Ltd., Kariya, Japan

[21] Appl. No.: 926,553

[22] Filed: Nov. 4, 1986

[30] Foreign Application Priority Data

Nov. 7, 1985 [JP] Japan ..... 60-249824
Oct. 8, 1986 [JP] Japan ..... 61-239981

[51] Int. Cl.[4] ..... C23C 22/07
[52] U.S. Cl. ..... 428/469; 204/181.4
[58] Field of Search ..... 204/181.4; 428/689, 428/469

[56] References Cited

U.S. PATENT DOCUMENTS 4,565,585 1/1986 Matsuda .

FOREIGN PATENT DOCUMENTS 60-238486 11/1985 Japan .

OTHER PUBLICATIONS

Journal of the Iron and Steel Institute of Japan (Tetsu to Hagane) 69 (13), 121, 1983.
"Metal Surface Technique" 1982, vol. 33, No. 7, p. 345.
Journal of the Iron and Steel Institute of Japan, vol. 66 (1980), No. 7, p. 927.

*Primary Examiner*—Nancy A. B. Swisher
*Attorney, Agent, or Firm*—Cushman, Darby & Cushman

[57] ABSTRACT

A conventional zinc phosphate chemical conversion film formed on an iron article comprises zinc phosphate hydrates, i.e., $Zn_3(PO_4)_2.4H_2O$ and $Zn_2Fe(PO_4)_2.4H_2O$. A novel chemical conversion film is mainly composed of $Zn_3(PO_4)_2.2H_2.4H_2O$. The ratio of $$\frac{Zn_3(PO_4)_2.2H_2O}{\{Zn_3(PO_4)_2.2H_2O\} + \{Zn_3(PO_4)_2.4H_2O\}}$$

is from 0.3 to less than 1. The problems of conventional chemical conversion film arise due to 4 moles of water of crystallization of the zinc phosphates which desiccates at a baking temperature of the paint. The small amount of water of crystallization of $Zn_3(PO_4)_2.2H_2O$ provides an improved chemical conversion film with respect to the corrosion resistance and the like.

6 Claims, 8 Drawing Sheets

(X 700)

(X 700)

( X 820 )

( X 820 )

ZINC PHOSPHATE CHEMICAL CONVERSION FILM AND METHOD FOR FORMING THE SAME

BACKGROUND OF THE INVENTION

1. Field of the Invention

The present invention relates to a zinc phosphate chemical conversion film, more particularly to the composition thereof, and to a method for forming the same.

2. Description of the Related Art

The conventionally known zinc phosphate chemical conversion film is formed by a high temperature bath having a temperature of 40° C. or higher, and the chemical composition thereof consists of $Zn_3(PO_4)_2.4H_2O$ (hopeite tetrahydrate), and $Zn_2Fe(PO_4)_2.4H_2O$ (phosphillite tetrahydrate).

When $Zn_3(PO_4)_2.4H_0$ in the above conventional zinc phosphate chemical conversion film is heated to a temperature of from 100° to 120° C., the water of crystallization is eliminated to yield $Zn_3(PO_4)_2.2H_2O$.

Journal of the Iron and Steel Institute of Japan (Tetsu to Hagane) 69 (13), 121, 1983 states, on page 121, that the $Zn_3(PO_4)_2.4H_2O$ in the above mentioned film is converted to $Zn_3(PO_4)_2.2H_2O$ due to a high temperature of 100° C. or higher generated at the time of baking the paint. When the change of $Zn_3(PO_4)_2.4H_2O$ to $Zn_3(PO_4)_2.2H2O$ takes place, as referred to in the above journal, the vacancies increase in the chemical conversion film correspondingly to the desiccation of two moles of water of crystallization from $Zn_3(PO_4)_2.4H_2O$, or alternatively, the structure of zinc phosphate chemical conversion film changes.

Accordingly, problems arise such that the adhesivity of the zinc phosphate chemical conversion film with the paint film is degraded, and further water deposited on the paint film passe through the vacancies and reaches the steel surface to cause the generation of rust.

SUMMARY OF THE INVENTION

The zinc phosphate chemical conversion film according to the present invention comprises $Zn_3(PO_4)_2.2H_2O$ and $Zn_3(PO_4)_2.4H_2O$, and exhibits an intensity ratio of the X-ray peaks of the $Zn_3(PO_4)_2.2H_2O$ with respect to the respective hydrates, i.e., the X-ray peak ratio of:

$$\frac{Zn_3(PO_4)_2.2H_2O}{\{Zn_3(PO_4)_2.2H_2O\} + \{Zn_3(PO_4)_2.4H_2O\}}$$

in the range of from 0.3 to less than 1.

In the present invention, the zinc phosphate chemical conversion film is used as the undercoating of paint on steels for removing the rust and enhancing the lubricating property upon cold-forging. The steels herein include, in addition to ordinary iron and steel, alloy steels and surface-treated steels, such as zinc-galvanized steels.

The surface-treated steel sheets, such as Zn galvanized steel sheets, are broadly used in automotive industry to strengthen the rust proofness of a coating film. Therefore, the application of chemical conversion film on the surface treated steel sheets are useful for improving the rust proofness of automobiles.

In the present invention, the $Zn_3(PO_4)_2.2H_2O$ ratio is from 0.3 to less than 1 as described above. When the quantity of $Zn_3(PO_4)_2.4H_2O$ increases in the chemical conversion film, the above described problems arise. The lower limit of $Zn_3(PO_4)_2.2H_2O$ ratio is therefore preferably 0.3. A smaller quantity of $Zn_3(PO_4)_2.4H_2O$ in the chemical conversion film, is preferable. The upper limit of $Zn_3(PO_4)_2.2H_2O$ ratio is therefore 1 (not including 0), and an optimum $Zn_3(PO_4)_2.2H_2O$ ratio is from 0.45 to less than 1.

A preferred method for forming the zinc phosphate chemical conversion film on the surface of steel, according to the present invention, is proposed in Japanese Unexamined Patent Publication No. 60-238486. In a summary of this method, the steel material is brought into contact with a zinc phosphate chemical conversion bath containing metal ions, oxyacid ions, and phosphate ions, but free of a directly added, active oxidizer, such as free nitrite ions, and hydrogen peroxide. The temperature of the bath is set to 40° C. or lower, the pH of the bath is set to 2.5~4.5, and the oxidation reduction potential of the bath is set to 150~550 mV in terms of Ag Cl electrode potential. Such a bath is a so-called normal temperature bath. By using the normal temperature bath, and the normal temperature-treating method without the direct addition of the active oxidizer, such as $NO_2^-$, the zinc phosphate chemical conversion film of the present invention can be formed.

Even in the above described normal temperature method, a number of devices are necessary for forming a zinc phosphate chemical conversion film containing a large quantity of $Zn_3(PO_4)_2.2H_2O$. The factors influencing the quantity of the $Zn_3(PO_4)_2.2H_2O$ are described hereinafter.

(1) Presence or Absence of the Promoting Agent in the Treating Bath

The promoting agent is an active oxidizer, such as free $NO_2^-$, and hydrogen peroxide. It is advantageous not to use an active oxidizer as the promoting agent. Even in the normal temperature bath, the presence of active oxidizer in the treating bath leads to an advance of the reaction of the formula (2), described later, in the arrow direction. In this case, the zinc phosphate chemical conversion film according to the present invention is formed with difficulty.

According to the method of Japanese Patent Application No. 59-93643, the components of the promoting agent are present in the bath in the form of a complex, and hence, are not in a free state, i.e., not active. Accordingly, the components of the promoting agent are inactive, so that the bath is extremely stable. The components of the promoting agent exhibit their functions only on the iron surface, and only when their reactions are exhibited do the reactions (3)~(6) described below occur, with the result that the chemical conversion film is formed on the iron surface. The chemical conversion film is therefore formed in such a manner that the complex ions directly participate in the film formation reactions only on the iron surface, and hence $Zn_3(PO_4)_2.2H_2O$ with a small water of crystallization is contained in the film in a great amount.

(2) Temperature of the Treating Bath

The temperature of the treating bath is desirably 40° C. or lower, particularly 35° C. or lower. That is, the influence of heat from the outside should be kept as small as possible. The lower limit of the bath temperature is 0° C.

(3) Composition of the Treating Bath

The composition of the treating bath is preferably in the following ranges.

$Zn^{2+} = 1.0 \sim 5.0$ g/l $H_2PO_4$=8.0~40.0 g/l

N component (in terms of $NO_3^-$)=1.5~10 g/l $Ni_2+$=50~500 mg/l (4) The pH and ORP of the bath is preferably in the following ranges:

pH=3.2~4.5, and in the pH range where no free acid forms. The ORP=260 mV or less, desirably from 100 mV to 260 mV in terms of AgCl electrode potential.

(5) Addition of F Ions

F ions are desirably contained in the treating bath at a concentration of from 75 mg/l to 300 mg/l, i.e., from 75 to 300 ppm. A more desirable concentration of the F ions is from 100 ppm to 200 ppm. It is necessary when treating zinc galvanized steels to include a higher concentration of F ions in the treating bath than when treating ordinary steels. For the F ions, a preferred additive is NaF (sodium fluoride).

When the steels are treated by the above method and within the ranges described above, a chemical conversion film according to the present invention containing a large amount of $Zn_3(PO_4)_2.2H_2O$ can be formed on the steel surface.

Note, directly before the chemical conversion treatment, the starting material may or may not be treated with the titanium phosphate-series liquid of the surface conditioning treatment for improving the densities of the chemical conversion film.

The process until the creation of the present invention is described more in detail hereinafter.

As is described in the Description of the Related Art, the conventional zinc phosphate chemical conversion film is formed in a high temperature bath having a temperature of 40° C. or higher. The composition of the conventional zinc phosphate chemical conversion film consists, as described in "Metal Surface Technique" 1982, Vol. 33, No. 7, page 345, of hopeite tetrahydrate ($Zn_3(PO_4)_2.4H_2O$) and phosphophillite tetrahydrate ($Zn_2Fe(PO_4)_2.4H_2O$). When the zinc phosphate chemical conversion film is used as an undercoating of an electrodepositing paint film, the P ratio of the zinc phosphate chemical conversion film expressed by the intensity ratio of the peaks obtained by the X-ray diffraction method is as follows, $$\frac{Zn_2Fe(PO_4)_2.4H_2O}{\{Zn_2Fe(PO_4)_2.4H_2O\} + \{Zn_3(PO_4)_2.4H_2O\}}$$

and exerts a great influence on the corrosion resistance of the electrodeposited paint film. That is, a film having a high P ratio is considered to be excellent, while a film having a low P ratio is considered to be poor. This is verified by the above mentioned "Metal Surface Technique" and by a number of publications, e.g., The Journal of The Iron and Steel Institute of Japan Vol. 66 (1980), No. 7, page 927. The recognitions as described above, however, are obtained from confirmation by a high temperature treatment. In addition, since it is difficult to include a $Zn_3(PO_4)_2.2H_2O$ in the zinc phosphate chemical conversion film formed by the treating bath having a temperature of 40° C. or higher, the available publications discussing the composition of the film virtually do not refer to the $Zn_3(PO_4)_2.2H_2O$.

In the above described high temperature bath, the formation reactions of the chemical conversion film are greatly subjected to the influence of the heat, and therefore, the dissolution of the starting material (iron and steel), on which the chemical conversion film is formed, is not small. As a result, a large amount of phosphophillite ($Zn_2Fe(PO_4)_2.4H_2O$) is present in the chemical conversion film. Accordingly, the fact that a film having a high P ratio has an excellent resistance indicates that such a film has a large amount of phosphophillite.

On the contrary, the formation reactions of a chemical conversion film in a normal temperature bath, an example of which is described hereinabove, are electrochemical. Most of the energy available for the film formation is the energy ($\Delta E$) generated along with the dissolution of iron (starting material) by the formula (1).

$$Fe \rightarrow Fe^{2+} + 2e + \Delta E \ldots \quad (1)$$

That is, the energy available for the formation of a chemical conversion film on the surface of starting material (iron) is considerably smaller than in the case of a high temperature bath. The zinc phosphate chemical conversion film obtained by the normal temperature bath contains, therefore, only an extremely small amount of $Zn_2Fe(PO_4)_2.4H_2O$, and the evaluation thereof by a P ratio is not appropriate. In other words, the zinc phosphate chemical conversion film obtained by the normal temperature bath is not considered excellent when evaluated by the P ratio. An appropriate evaluation of the zinc phosphate chemical conversion film obtained by the normal temperature bath can be made by an index other than the P ratio. The "$Zn_3(PO_4)_2.2H_2O$ ratio" alleged in the present invention is an evaluation index which reflects the characteristics of the normal temperature bath and indicates better quality as a greater ratio.

Note, considerations are given as to why the zinc phosphate chemical conversion film formed by a high temperature bath is mainly composed of $Zn_3(PO_4)_2.4H_2O$ and $Zn_2Fe(PO_4)_2.4H_2O$. The formation reactions of a chemical conversion film is greatly influenced by heat, and such an influence exists not only on the iron surface but also in the treating bath. The effective components for the chemical conversion reactions present in the bath ($Zn^{2+}$, $H_2PO_4^-$, and N components such as $NO_3^-$) therefore cannot exist in the bath in the ionic state for a long period of time. Therefore, presumably the reaction as shown by the formula (2) occurs in the bath.

$$3Zn^{2+} + 2H_2PO_4^- + 4e + 4H_2O \rightarrow Zn_3(PO_4)_2.4H_2O\downarrow + 2H_2 \ldots \quad (2)$$

The material $Zn_3(PO_4)_2.4H_2O$ is formed in the bath, and since the treating bath is heated, the reaction (2) advances, in accordance with the principle of chemical reaction, in the endothermic direction. This reaction advances until the level of bath where the water of crystallization is contained in the film is stabilized. In fact, in the case of a high temperature bath, the sludge formed in the treating bath is confirmed to be mainly composed of $Fe(PO_4).nH_2O$ and $Zn_3(PO_4).4H_2O$. As described above, in a high temperature bath, as an evident result of the chemical reaction, $Zn_3(PO_4)_2.4H_2O$ is formed, and in the chemical conversion film, a large amount of $Zn_3(PO_4)_2.4H_2O$ is contained. $Zn_2Fe(PO_4)_2.4H_2O$ is also contained in a chemical conversion film.

On the contrary, in the normal temperature bath, the formation reactions of a chemical conversion film occur electrochemically without being subjected to the influence of heat from the outside.

Anode reactions $$Fe \rightarrow Fe^{2+} + 2e \ldots \quad (3)$$

$$Fe^{2+} + H_2PO_4^- \rightarrow FePO_4 + 2H^+ + e \ldots \quad (4)$$

$$3Zn^{2+} + 2H_2.\ Zn_3(PO_4)_4 \rightarrow + 4H^+ \ldots \quad (5)$$

Cathode reaction $$NO_2^- + 2H_2 + e \rightarrow NO\downarrow + 4H^+ \ldots \quad (6)$$

A chemical conversion film ($FePO_4 + Zn_3(PO_4)$) is formed on the steel surface by the reactions (3)~(6). In the electrochemical reaction system, the reaction where only $H^+$ participates, i.e., $2H^+ + 2e \rightarrow H_2$, does not occur, partly due to the normal temperature of the bath.

In the normal temperature bath, solely because of the normal temperature, the chemical conversion treating bath is stable. Such a reaction as (2), where the effective components-ions mutually react, does not appear to occur. The effective components-ions form a complex and are stably present in the bath. The formation of a chemical conversion film occurs quickly on the steel surface, through the reactions (3)~(6), only when steel (starting material) is brought into contact with the treating bath. The zinc phosphate chemical conversion film is formed on the steel surface only when the $Zn^{2+}$, $H_2PO_4^-$ and the like are caused to react on the steel surface. As a result, $Zn_3(PO_4)_2.2H_2O$ with a small amount of water of crystallization is contained in the zinc phosphate chemical conversion film. It is possible, regarding the high temperature bath, to explain that the reactions are completed to yield $Zn_3(PO_4)_2.4H_2O$, which aggregates to form the zinc phosphate chemical conversion film. The film formation in the high temperature bath is greatly related to the (dissolution) quantity of iron on the steel surface, so that $Zn_2Fe(PO_4)_2.4H_2O$ is contained in a quantity such that the characteristics or the film are influenced thereby. The chemical conversion film with a small $Zn_2Fe(PO_4)_2.4H_2O$ can be said to be that in which the $Zn_3(PO_4)_2.4H_2O$ preliminarily synthetized in the treating bath is merely attached to the iron (starting material) surface. The adhesivity is greatly lessened in such a film, and the overall characteristics degraded.

A description follows of the influences of F ions in the treating bath.

The hydrogen bond energy of H (hydrogen) . . . F is approximately 10 kcal/mol. The hydrogen bond energy of H . . . 0 (oxygen) is approximately 7 kcal/mol. This means that the presence of F ions leads to disorder in the standard hydration state of water and suppresses the bonding of oxygen atoms of water (coordination of $H_2O$). Presumably, by such actions of the F ions, the formation of $Zn_3(PO_4)_2.4H_2O$ is impeded. The concentration of F ions in the treating bath is, as described hereinabove, in the range of from 75 ppm to 300 ppm. If the F concentration becomes less than the 75 ppm, the $Zn_3(PO_4)_2.2H_2O$ ratio does not arrive at the 0.3 value of the present invention. On the other hand, if the F concentration exceeds 300 ppm, the pH stability of the treating bath is impaired. Note, in the case of the spray method, the pressure and quantity for applying the chemical conversion liquid should be contemplated for providing a high $Zn_3(PO_4)_2.2H_2O$ ratio, since, at a high pressure for applying a chemical conversion liquid, oxidation of the steel surface will be promoted. The oxidation energy greatly participates in the formation of $Zn_3(PO_4)_2.4H_2O$. Accordingly, when the oxidation of steel is promoted depending upon the application pressure, $Zn_3(PO_4)_2.4H_2O$ is liable to form. The application pressure of the chemical conversion liquid therefore should be suitably controlled to an optimum value depending upon the treating plant, i.e., the optimum value will vary depending upon the treating plant. On the other hand, regarding the application quantity, provided that the treating agent is uniformly sprayed over the parts to be treated, the surface of the parts to be treated, on which the drops of the treating liquid impinge, increase if they are finely divided, and as a consequence, the oxidizing ability of the chemical conversion reaction is enhanced. Accordingly, to form a film having a high $Zn_3(PO_4)_2.2H_2O$ ratio, the application quantity and the size of liquid drops should be appropriately selected depending upon the respective treating plants. The means for placing the chemical conversion treating liquid in contact with the surface of steel parts may be, in addition to the spray method described above, the dip method.

The applicant emphasizes again the differences between a high temperature bath and the normal temperature bath. Since the reactions in a high temperature bath and the normal temperature bath are different, different indexes are necessary for evaluating the properties of zinc phosphate chemical conversion films formed by the respective baths. In the normal temperature bath, since the dissolution quantity of iron is small on the steel surface, the method for forming a chemical conversion film is different from that in a high temperature method. A novel index for evaluating this method is necessary. This index is provided by the present invention as the $Zn_3(PO_4)_2.2H_2O$ ratio.

DESCRIPTION OF THE PREFERRED EMBODIMENTS

The effects attained by the present invention are now described.

First, the zinc phosphate chemical conversion film according to the present invention exhibits an improved corrosion resistance after paint coating.

Figure 1:
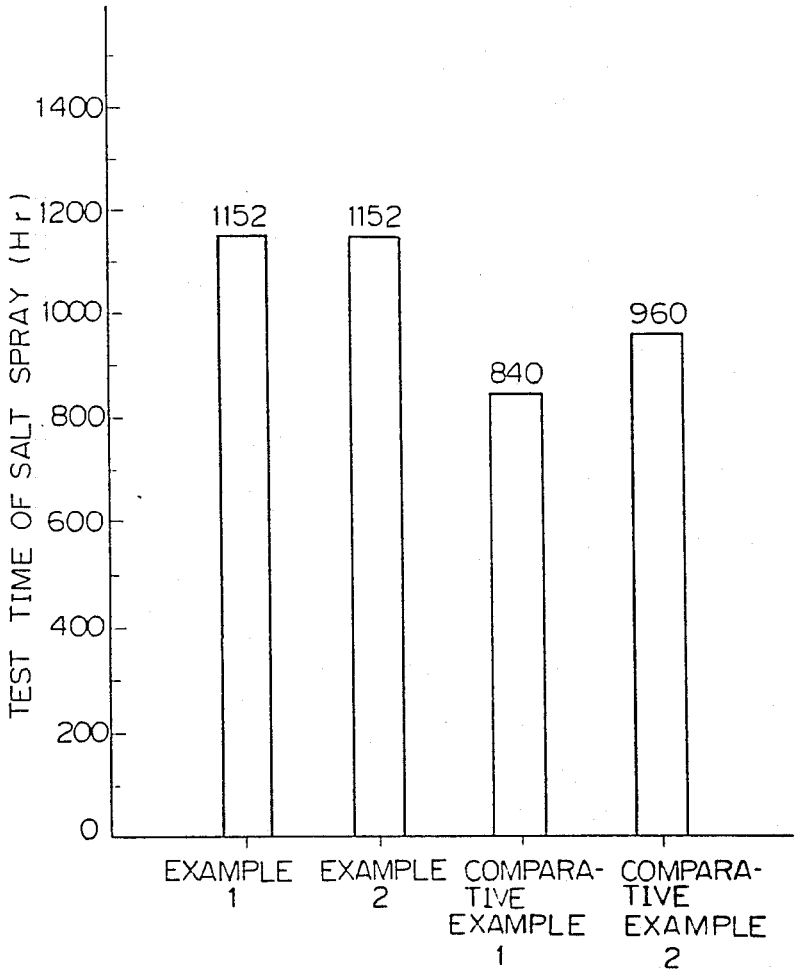
FIG. 1 and FIG. 2 are the graphs showing the characteristics of the zinc phosphate chemical conversion films and illustrate an effect of the present invention.
Figure 2:
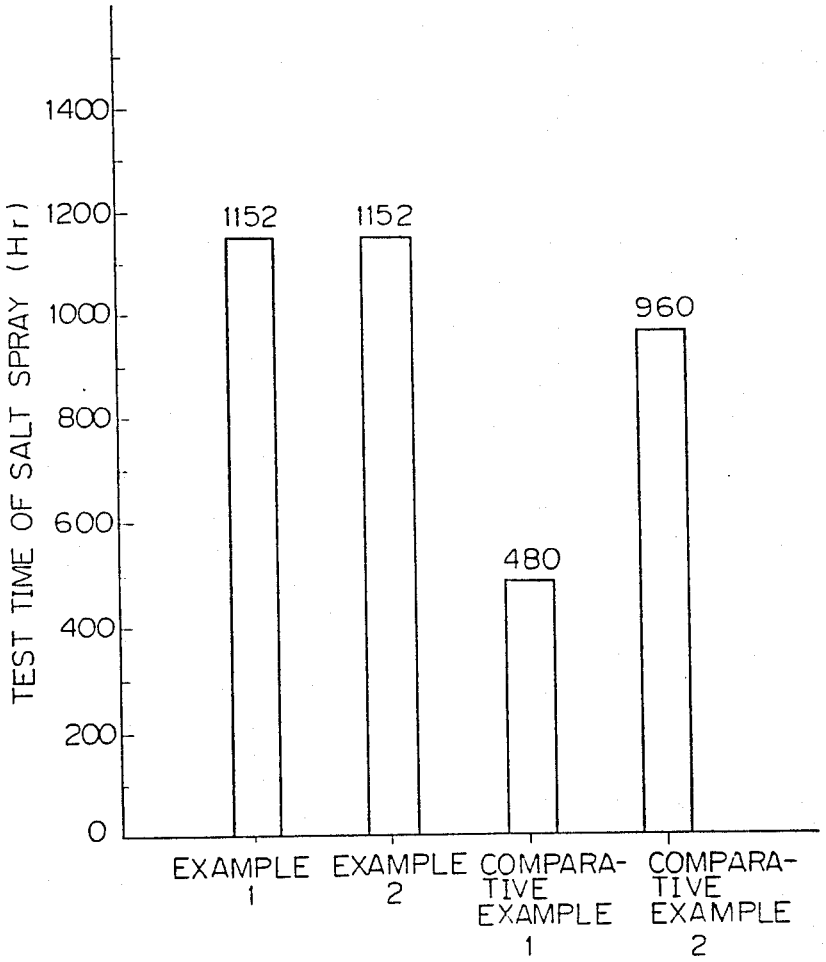

FIGS. 1 and 2 show the results of the salt water mist spray test stipulated in JIS-Z-2371 of the chemical conversion treated and paint-coated samples. The examples of the chemical conversion treatment are "Inventive Example 1", "Inventive Example 2", "Comparative Example 1" (film obtained by a high temperature treatment), and "Comparative Example" (film obtained by a normal temperature treatment but not the inventive treatment). The paint coating was carried out by coating an epoxy-solvent paint or by a cation-electrodeposition. The paint films were subjected to a salt spray test (method of JIS-Z-2371).

The results of FIG. 1 show that the chemical conversion film according to the present invention has an improved corrosion resistance.

Second, the chemical conversion film according to the present invention exhibits, even at a thin film or small weight of deposition, an improved insulating property. In Example 1 of the present invention, the deposition weight is 2.7 g/m$^2$ and small. Nevertheless, the short time insulation breakdown test of solid insulating material stipulated in JIS-C-2110 revealed an alternating current-breakdown voltage of 180 V. In order to obtain a film having the same break-down voltage by means of the conventional high temperature treating method, a deposition weight of 8 g/m$^2$ is necessary. The chemical conversion film according to the present invention is mainly composed of $Zn_3(PO_4)_2.2H_2O$ and is dense. As a result, even though thin, the voltage resistance of the film is high, taking into consideration the inorganic characteristics of the film.

The present invention is hereinafter described by way of Examples which however do not in any way restrict the present invention.

EXAMPLE 1

Cold-rolled steel sheets 70 mm×150 mm×2 mm (thickness) in size were subjected to the following processes: degreasing (spray of 2% bath of Fine Cleaner 4389 (trade name, producer by Nihon Parkerizing), at 50° C., for 3 minutes→water rinsing (normal temperature spray for 1 minute)→water rinsing (normal temperature spray for 1 minute)→chemical conversion treatment→water rinsing (normal temperature spray for 1 minute)→pure water-rinsing (normal temperature spray for 30 seconds)→drying (100° C.×5 minutes). The conditions for the chemical conversion treatment are shown in Table 1. The additive as F ions is NaF.

TABLE 1

| | | |
|---|---|---|
| Temperature | 27~29° C. | |
| Composition of Treating Bath | $Zn^{2+}$ (g/l) | 3.0 |
| | $H_2PO_4^-$ (g/l) | 14.0 |
| | N components (as $NO_3^-$) (g/l) | 4.3 |
| | $Ni^{2+}$ (mg/l) | 160 |
| | $F^-$ (mg/l) | 200 (200 ppm) |
| Total Acidity of Treating Bath | 12.5 points | |
| pH of Treating Bath | 3.5 | |
| ORP of Treating Bath | 230 mV (AgCl electrode potential) | |
| Spray Pressure | 0.5 kg/cm$^2$ | |

Figure 3:
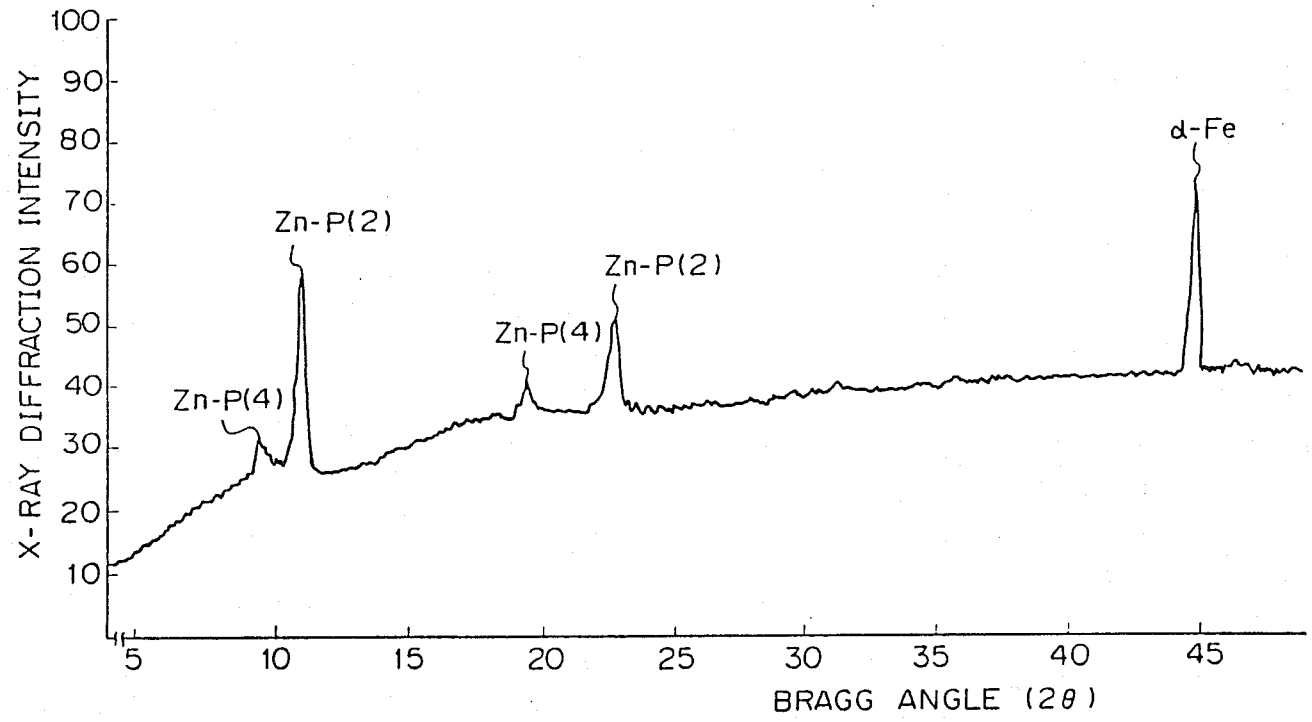
FIGS. 3 through 6 are X-ray diffraction charts of the zinc phosphate chemical conversion films according to the present invention and comparative examples.

In the present example, the deposition weight of the chemical conversion film formed was 2.7 g/m$^2$. The SEM photograph of the chemical conversion film is shown in FIG. 7. The X-ray diffraction chart is shown in FIG. 3. The X-ray used in all of the examples for the X-ray diffraction was a Cu-K$\alpha$ ray. In FIG. 3, as well as FIGS. 4, 5, and 6 of the later described examples, Zn-P(2) indicates $Zn_3(PO_4)_2.2H_2O$, Zn-P(b) indicates $Zn_3(PO_4)_2.2H_2O$, Zn-Fe-P(4) indicates $Zn_2Fe(PO_4)_2.4H_2O$, and $\alpha$-Fe indicates the steel sheet itself, with regard to the X-ray diffraction intensity.

Note, the $Zn_3(PO_4)_2.2H_2O$ ratio calculated from the X-ray diffraction chart of FIG. 3 is 0.8, and the film formed in this example is that of the present invention.

On the chemical conversion film, an epoxy series solvent painting (Orga 1000E6 (trade name, made by Nippon Paint), film thickness of 18 $\mu$m) was applied. In addition, on the chemical conversion film, cation electrodeposition painting (Electron #9400 (trade name) producer, Kansai Paint, film thickness of 15 $\mu$m) was applied. The epoxy and cation paints were baked at 180° C. for 15 minutes and 175° C. for 20 minutes, respectively. The paint coatings were then subjected to the salt water spray test stipulated in JIS-Z-2371. The time in which the size of the cross cut paint parts becomes 3 mm in one side, is shown in FIGS. 1 and 2. In FIG. 1, the result of solvent coating is shown as Example 1, and in FIG. 2 the result of the electrodeposition coating is shown as Example 1. An improved corrosion resistance of the painted articles with the use of the chemical conversion film according to the present invention was confirmed by these results.

EXAMPLE 2

The same test pieces as in Example 1 were used, and the same process (method) as in Example 1 was carried out, except that, directly before the chemical conversion treatment, the surface conditioning treatment by the 0.3% bath of Prepan Z (trade name, titanium phophate series-surface conditioner, made by Nihon Parkerizing) over the period of 30 seconds and the conditions for the chemical conversion treatment as given in Table 2. The additive as $F^-$ ions was NaF.

TABLE 2

| | | |
|---|---|---|
| Temperature | 27~29° C. | |
| Composition of Treating Bath | $Zn^{2+}$ (g/l) | 1.6 |
| | $H_2PO_4^-$ (g/l) | 13.0 |
| | N components (as $NO_3^-$) (g/l) | 3.5 |
| | $Ni^{2+}$ (mg/l) | 100 |
| | $F^-$ (mg/l) | 100 (100 ppm) |
| | $Cr^{3+}$ (mg/l) | 15 |
| Total Acidity of Treating Bath | 11.0 points | |
| pH of Treating Bath | 3.65 | |
| ORP of Treating Bath | 220 mV (AgCl electrode potential) | |
| Spray Pressure | 0.5 kg/cm$^2$ | |

Figure 8:
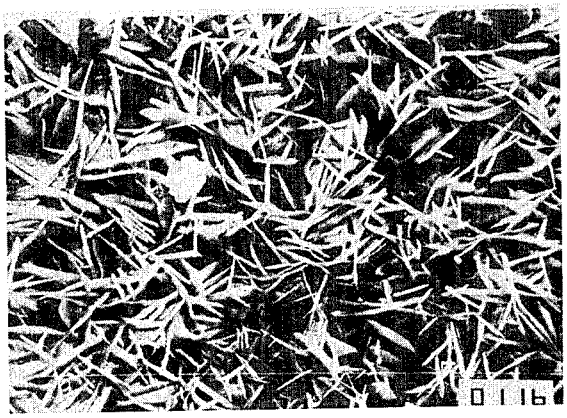

In the present example, the deposition weight of the chemical conversion film formed was 1.9 g/m$^2$. The SEM photograph of the chemical conversion film is shown in FIG. 8. The X-ray diffraction chart is shown in FIG. 4.

Figure 4:
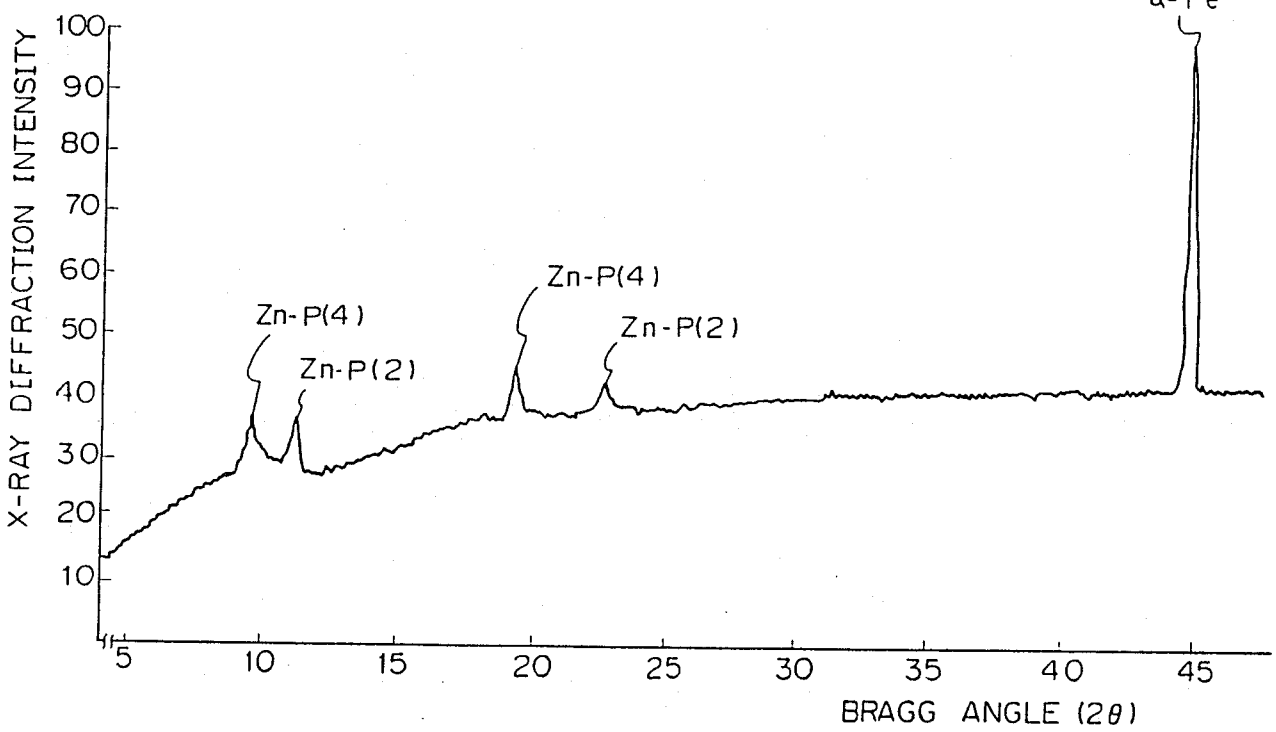

Note, the $Zn_3(PO_4)_2.2H_2O$ ratio calculated from the X-ray diffraction chart of FIG. 4 is 0.47 and the film formed in this example is that of the present invention.

On the test pieces (cold-rolled steel sheets) having a chemical conversion film thereon, the solvent paint and the electrodeposition paint were applied as in Example 1, and then the test pieces were subjected to the salt water spray test. The results are shown in FIG. 1 as Example 2 and in FIG. 2 as Example 2. An improved corrosion resistance of the painted articles with the use of the chemical conversion film according to the present invention was confirmed by these results.

COMPARATIVE EXAMPLE 1

The same test pieces were used and the same methods carried out as in Example 1, except for the chemical conversion treatment, to form a zinc phosphate chemical conversion film on the steel surface. The zinc phosphate chemical conversion treatment was carried out by the spray method under the conditions as given in Table 3.

TABLE 3

| | | |
|---|---|---|
| Temperature | 50~55° C. | |
| Composition of Treating Bath | $Zn^{2+}$ (g/l) | 2.62 |
| | $H_2PO_4^-$ (g/l) | 8.60 |
| | $NO_3^-$ | 3.82 |
| | $Ni^{2+}$ (mg/l) | 100 |
| | $F^-$ (mg/l) | 50 (50 ppm) |
| Total Acidity of Treating Bath | 12.2 points | |
| Acidity of Free Acid in Treating Bath | 0.6 point | |
| Concentration of Promoting Agent in Treating Bath | 2.5 points | |
| Spray Pressure | 0.8 kg/cm$^2$ | |

Figure 9:
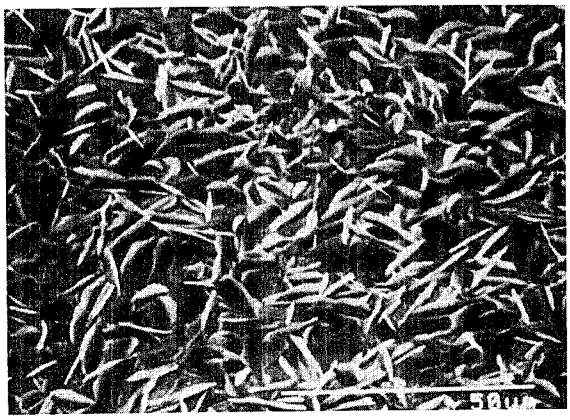

In the present example, the deposition weight of the chemical conversion film formed was 1.84 g/m$^2$. The SEM photograph of the chemical conversion film is shown in FIG. 9. The X-ray diffraction chart is shown in FIG. 5.

Figure 5:
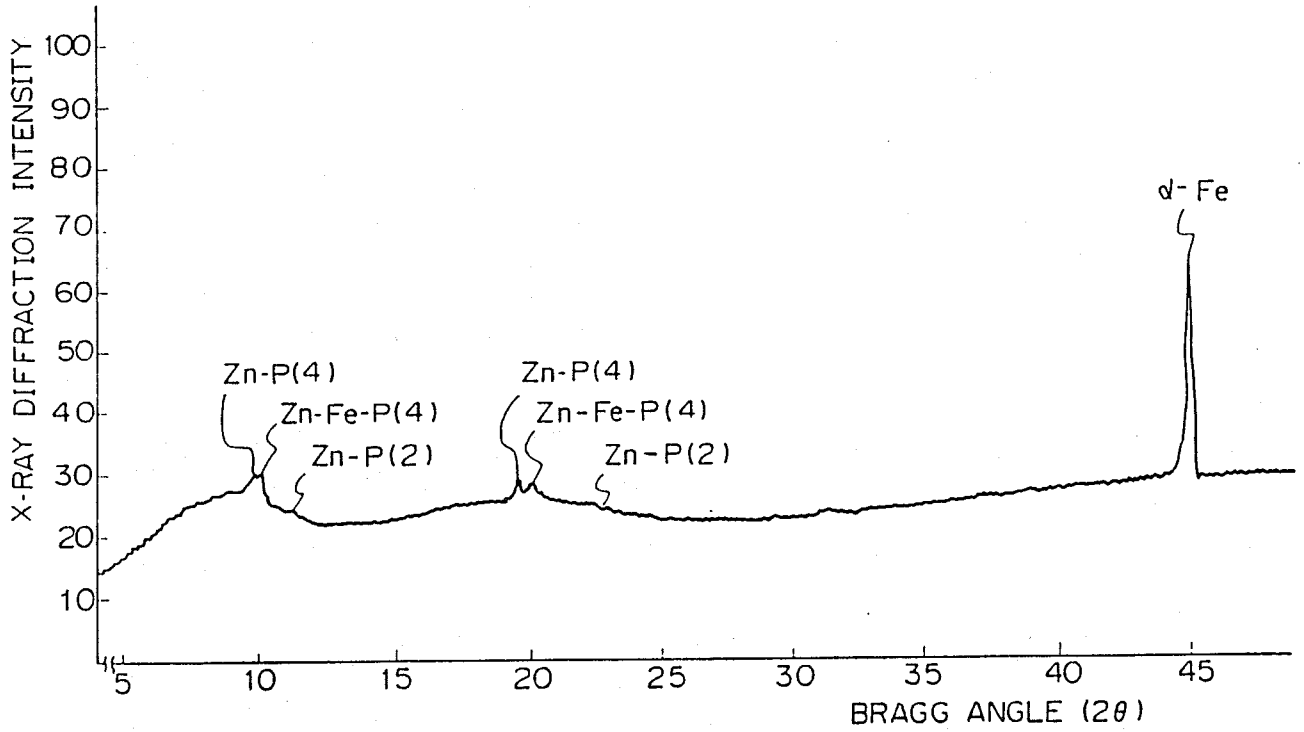

Note, the $Zn_3(PO_4)_2.2H_2O$ ratio calculated from the X-ray diffraction chart of FIG. 5 is 0.10 and the film formed in this example is not according to the present invention.

The corrosion resistance of the test pieces with the chemical conversion films and paints as in Example 1 is shown in FIG. 1 as Comparative Example 1 and in FIG. 2 as Comparative Example 1. The corrosion resistance of painted articles with the use of the chemical conversion film of the comparative example is inferior to that according to the present invention.

COMPARATIVE EXAMPLE 2

The same test pieces were used and the same method were carried out as in Example 1, except for the chemical conversion treatment, to form a zinc phosphate chemical conversion film on the steel surface. The zinc phosphate chemical conversion treatment was carried out by the spray method under the conditions as given in Table 4.

TABLE 4

| | | |
|---|---|---|
| Temperature | 26° C. | |
| Composition of Treating Bath | $Zn^{2+}$ (g/l) | 3.68 |
| | $H_2PO_4$ (g/l) | 11.4 |
| | N components (as $NO_3^-$) | 3.13 |
| | $Ni^{2+}$ (mg/l) | 100 |
| | $F^-$ (mg/l) | 50 (50 ppm) |

TABLE 4-continued

| | |
|---|---|
| Total Acidity of Treating Bath | 16.6 points |
| Acidity of Free Acid in Treating Bath | 0 point |
| Concentration of Promoting Agent in Treating Bath | 0.8 points |
| pH of Treating Bath | 3.4 |
| OPR of Treating Bath | 300 mV (AgCl electrode potential) |
| Spray Pressure | 0.5 kg/cm$^2$ |

Figure 10:
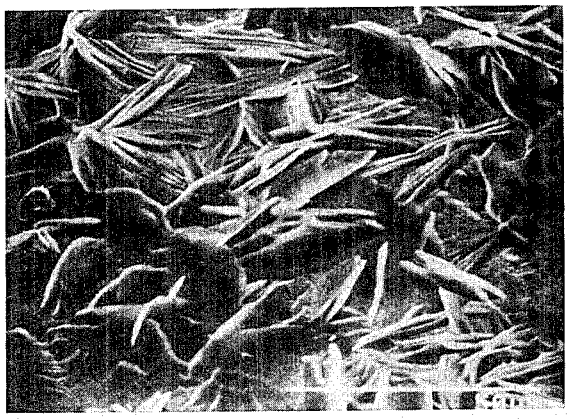

The treating bath was a normal temperature bath with the use of a promoting agent. In the present example, the deposition weight of the chemical conversion film formed was 2.97 g/m. The SEM photograph of the chemical conversion film is shown in FIG. 10. The X-ray diffraction chart is shown in FIG. 6.

Figure 6:
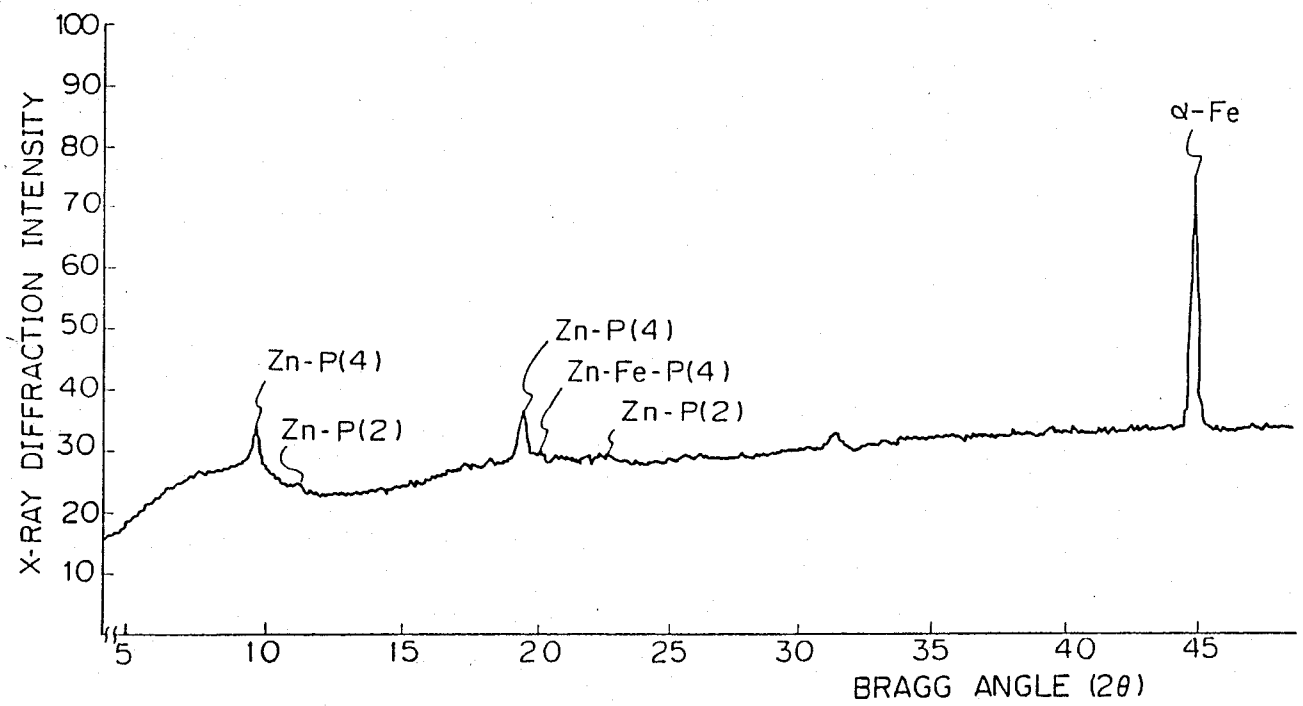
Figure 7:
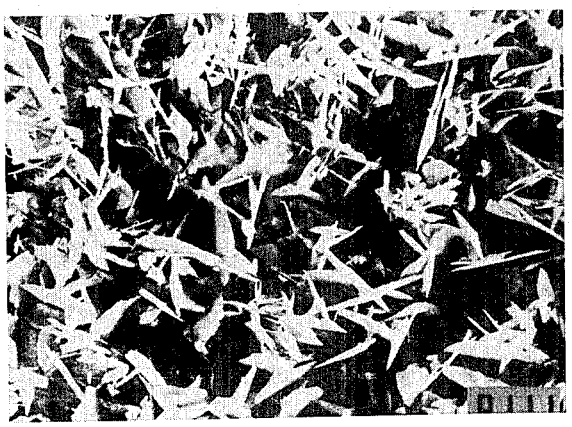
FIGS. 7 and 8 are photographs showing the macrocrystal structure of the zinc phosphate chemical conversion film according to the present invention; and, FIGS. 9 and 10 are photographs showing the macrocrystal structure of zinc phosphate chemical conversion film according to the present invention.

Note, the $Zn_3(PO_4)_2.2H_2O$ ratio calculated from the X-ray diffraction chart of FIG. 6 is 0.13, and the film formed in this example is not according to the present invention.

The corrosion resistance of the test pieces with the chemical conversion films and paints as in Example 1 is shown in FIG. 1 as Comparative Example 2 and in FIG. 2 as Comparative Example 2. The corrosion resistance of painted articles with the use of the chemical conversion film of the comparative example is inferior to that according to the present invention.

I claim:

1. A zinc phosphate chemical conversion film formed on an iron article, comprising a $Zn_3(PO_4)_2.2H_2O$ and a $Zn_3(PO_4)_2.4H_2O$, and exhibiting an intensity ratio of an X-ray peak of the $Zn_3(PO_4)_2.2H_2O$ with respect to the respective hydrates, i.e., the X-ray peak ratio of:

$$\frac{Zn_3(PO_4)_2.2H_2O}{\{Zn_3(PO_4)_2.2H_2O\} + \{Zn_3(PO_4)_2.4H_2O\}}$$

in the range of from 0.3 to less than 1.

2. A zinc phosphate chemical conversion film according to claim 1, wherein said film consists essentially of $Zn_3(PO_4)_2.2H_2O$ and $Zn_3(PO_4)_2.4H_2O$ and said X-ray peak ratio is from 0.45 to less than 1.

3. A zinc phosphate chemical conversion film according to claim 1, which is used as an paint undercoating film.

4. A zinc phosphate chemical conversion film according to claim 1, which is used as a lubricating coating.

5. A zinc phosphate chemical conversion film according to claim 1, which is substantially free of $Zn_2Fe(PO_4)_2.4H_2O$.

6. A zinc phosphate chemical conversion film according to claim 1, 2, or 3, formed by an electrochemical conversion reaction at a normal temperature and in the absence of an active oxidizer.

* * * * *